US007475666B2

(12) United States Patent
Heimbecker

(10) Patent No.: US 7,475,666 B2
(45) Date of Patent: Jan. 13, 2009

(54) STROKE CONTROL ASSEMBLY

(76) Inventor: John A. Heimbecker, 1637 Wiedner Rd., Cibolo, TX (US) 78108

( * ) Notice: Subject to any disclaimer, the term of this patent is extended or adjusted under 35 U.S.C. 154(b) by 143 days.

(21) Appl. No.: 11/517,159

(22) Filed: Sep. 7, 2006

(65) Prior Publication Data

US 2008/0092846 A1 Apr. 24, 2008

(51) Int. Cl.
*F02B 75/32* (2006.01)
*F16H 19/08* (2006.01)

(52) U.S. Cl. ..... 123/197.1; 74/29

(58) Field of Classification Search ... 123/197.1–197.5; 74/29, 30, 34

See application file for complete search history.

(56) References Cited

U.S. PATENT DOCUMENTS

| | | | |
|---|---|---|---|
| 1,123,172 | A | 12/1914 | Compton |
| 1,292,171 | A | 1/1919 | Walk |
| 1,316,437 | A | 9/1919 | Flood |
| 1,399,666 | A | 12/1921 | Short |
| 1,567,172 | A | 12/1925 | Powell |
| 1,654,378 | A | 12/1927 | Marchetti |
| 1,714,847 | A | 5/1929 | Caminez |
| 1,734,489 | A | 11/1929 | Jereb |
| 2,482,136 | A | 9/1949 | Wright |
| 3,026,859 | A | 3/1962 | Barnett |
| 3,267,917 | A | 8/1966 | Bargero |
| 3,290,950 | A | 12/1966 | Carlson |
| 3,853,100 | A | 12/1974 | Braun |
| 3,861,222 | A | 1/1975 | Braun |
| 3,868,932 | A | 3/1975 | Toth |
| 4,433,649 | A | 2/1984 | Shin |
| 4,498,430 | A | 2/1985 | Giuliani |
| 4,555,903 | A | 12/1985 | Heaton |
| 4,907,548 | A | 3/1990 | Lee |
| 4,941,396 | A | 7/1990 | McCabe |
| 5,528,946 | A | 6/1996 | Yadegar |
| 5,673,665 | A | 10/1997 | Kim |
| 5,934,243 | A | 8/1999 | Kopystanski |
| 5,992,356 | A | 11/1999 | Howell-Smith |
| 6,349,694 | B1 | 2/2002 | Babington |
| 6,354,252 | B1 | 3/2002 | Rabhi |
| 6,474,287 | B2 | 11/2002 | Babington |
| 6,601,551 | B1 | 8/2003 | Rabhi |
| 6,981,483 | B1 | 1/2006 | Keip |
| 2001/0029922 | A1 | 10/2001 | Dow |
| 2002/0043225 | A1 | 4/2002 | Babington |
| 2003/0070648 | A1 | 4/2003 | Giuliani |
| 2004/0261750 | A1 | 12/2004 | McKeown |

*Primary Examiner*—Noah Kamen
(74) *Attorney, Agent, or Firm*—Law Office of William F. Ryann

(57) ABSTRACT

A stroke control assembly for an engine. The assembly is configured to transfer power from a rectilinear moving piston by way of an interaction between a control plate and a flywheel of the assembly. The control plate is configured to phase shift or overrun the flywheel at predetermined locations of interface between a rectilinear moving piston and the control plate. In this manner, significant forces that might otherwise be applied to the control plate, may be avoided, following these predetermined locations. The control plate may also allow a firm engagement of a mechanical rectifier (one way clutch) while tracking a substantially constant velocity piston device for about 240° of rotation thereof to optimally enhance collection of power from the rectilinear moving piston.

18 Claims, 7 Drawing Sheets

STROKE CONTROL ASSEMBLY

BACKGROUND

Embodiments described relate to engines. In particular, embodiments of assemblies for controlling a rectilinear power stroke of an engine and directing power derived therefrom are described.

BACKGROUND OF THE RELATED ART

Internal combustion and other engines are employed to convert the reciprocating generally rectilinear movement of pistons into a rotating movement of a crankshaft. For example, a piston within a cylinder may be fired, applying the downward force of a piston's power stroke through a rod and to a rotatable or rotable crankshaft. In this manner, a unidirectional rotation of the crankshaft may be achieved. The rotating crankshaft in turn may be coupled to power output for the engine allowing a user to obtain the benefit of power from the engine.

As described above, the crankshaft may provide the power output for the engine by its rotation in one direction during the power stroke of the piston. However, the continued rotation of the crankshaft may then perform the function of a crank, guiding the return of the pistons into position for the firing of another power stroke. Thus, if the mass of the crankshaft and its associated flywheel are sufficient, the crankshaft may enable both the power output of the engine and the guided return of pistons for the continued running of the engine.

The above described technique of transforming a generally rectilinear movement of pistons into the rotating movement of a crankshaft to obtain power from an engine is effective. However, certain disadvantages exist. For example, a loss of efficiency may occur. That is, in the process of employing rectilinear piston movement to drive a rotating crankshaft, forces may be applied to walls of the above noted cylinder, robbing the system of energy. That is, although the movement of the piston is entirely rectilinear, the movement of its connecting rod or pitman arm is not. Therefore, during the non-power or upstroke of the rotating crankshaft and piston, the piston may be driven both upward and against the sidewall of the cylinder to a degree. Similarly, the piston may be forced downward and against the opposite sidewall of the cylinder during the power stroke. The forces exerted against the cylinder sidewalls result from the fact that the piston, through its rod, is coupled to a rotating crank of a crankshaft. Another problem is that, in certain cases, it might be advantageous to seal off the bottom of the cylinder. This is not practical if the piston rod is not following a rectilinear path.

In order to address inefficiencies of the above described piston rod movement, engines have been configured which do employ rectilinear piston rod movement. These efforts generally include an attempt to also take advantage of a 90° tangent intersection of the rectilinear moving piston rod and a rotating power output mechanism. That is, the piston rod becomes part of a rack assembly. So, a rack and pinion interface of the piston and power output mechanism becomes possible. Conceivably, employment of a rack and pinion interface would allow for better use of torque in driving the power output in addition to eliminating inefficient cylinder side forces as noted above. Also, the possibility for sealing the bottom of the cylinder becomes practical.

One manner of achieving a rectilinear piston rack movement is to divide the functions of a conventional crankshaft into separate devices. That is, a power output shaft may interface a piston rack of rectilinear movement via a pinion gear and a mechanical rectifier, while a separate crank assembly interfaces a piston rod at the end of the piston rack for the guided return of the piston. This manner of achieving a rack and pinion interface of the power output shaft and piston does eliminate the inefficiency of side forces against the cylinder. However, other inefficiencies and concerns persist. For example, in this approach, the side forces are simply relocated to the bottom of the rack. But, even more importantly, the only time the mechanical rectifier may be engaged, (assuming the flywheel is turning at substantially constant angular velocity) is when the piston rack is moving at substantially constant linear velocity. This is a problem for this approach because the linear velocity of a piston rack following a crankshaft in this fashion is never constant. The rack is either speeding up or the rack is slowing down.

Unfortunately, the rectilinear piston rack movement described above fails to optimize torque in driving the power output. That is, all of the power from the downward power stroke of the piston is still ultimately shared between the power output shaft and the crank assembly. Given the rotating nature of the crank assembly, this means that the amount of torque present at the outset of the power stroke is negligible. The separation of the crank function into a separate assembly fails to avoid this problem. Furthermore, separation of the crankshaft into these separate components eliminates the possibility of starting the engine by turning of the output shaft. That is, there is no positive feedback. Thus, while such a configuration allows for a rectilinear piston rack stroke, other problems arise without the benefit of optimizing torque in driving the power output.

In avoiding problems associated with the dividing of crankshaft functions into separate devices, "stroke control" assemblies have been devised that allow for rectilinear piston rack reciprocation by way of an assembly that effectively rotates relative to the rectilinear moving piston rack. The control assembly may perform the crank function of guiding the return of the piston while also maintaining at least a geared coupling to the power output.

A control assembly capable of rotating relative to a rectilinear moving piston rack may be configured to avoid problems such as with positive feedback, as noted above. Unfortunately, in most applications, all of the power from the downward power stroke of the piston is still ultimately shared between the control assembly and the power output. Therefore, given that the crank assembly is still a rotable device coupled to the piston, there remains the problem of negligible torque at the outset of the power stroke, thus, ultimately affecting the power output. As a result, even with a piston of rectilinear movement allowing a rack and pinion interface, a practical optimization of torque in driving the power output remains elusive.

SUMMARY

A rotable assembly, or 'rotatable ' as may by referenced herein, is provided to direct power from a moving piston. The assembly includes a control plate coupled to a flywheel. The control plate includes a guide track for interfacing the piston and may rotably phase shift ahead of the flywheel as the piston moves from encountering a predetermined location of the guide track to encountering an engagement portion of the guide track. In this manner, force otherwise applied to the control plate may be substantially eliminated.

DETAILED DESCRIPTION

Embodiments are described with reference to certain assemblies for capturing power from a fired piston and returning the piston to a firing position. These assemblies are particularly adept at efficiently transferring power from the fired piston to the power output of an engine.

Figure 1:
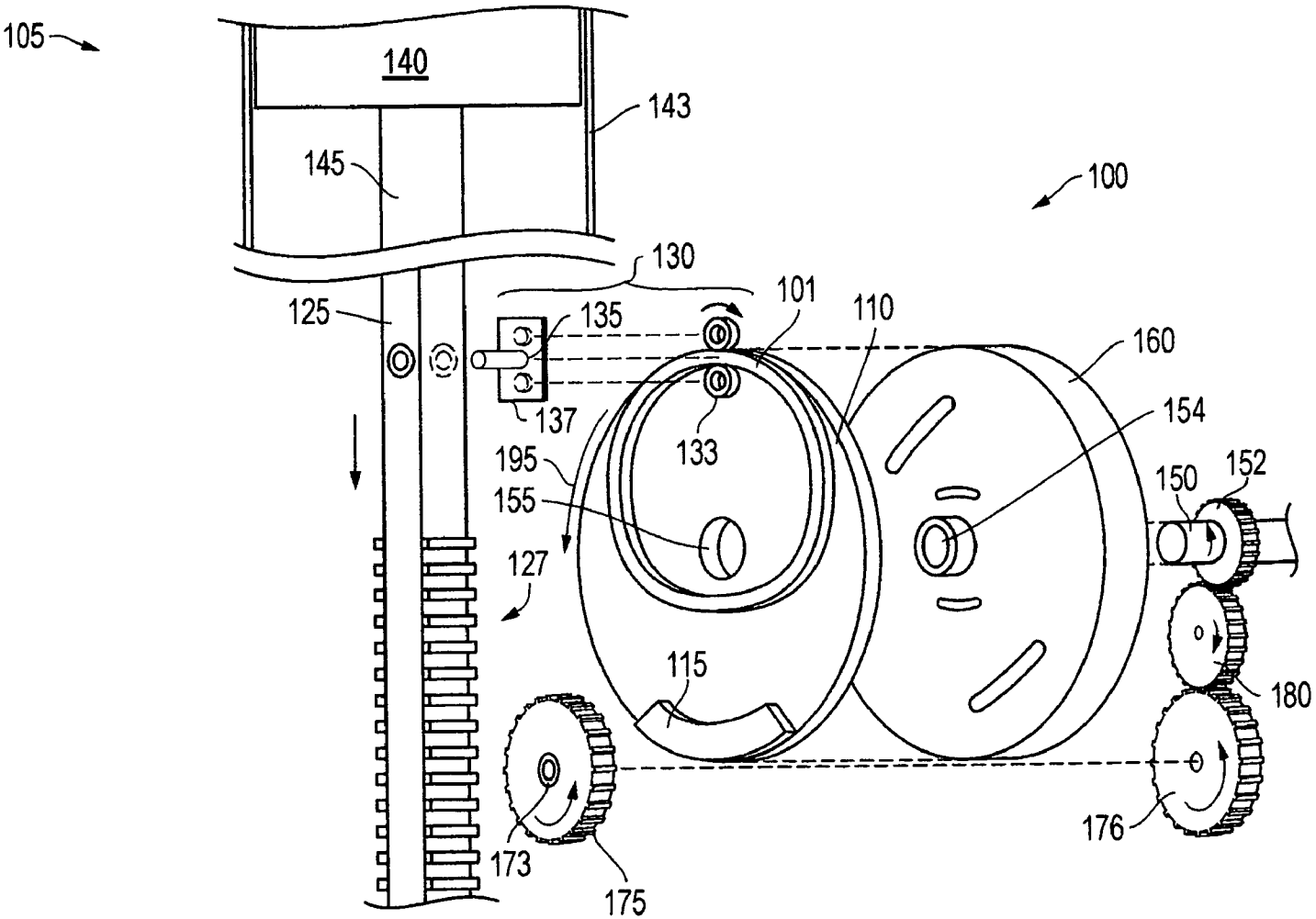
FIG. 1 is an exploded perspective view of an embodiment of a stroke control assembly (SCA) as part of an engine.

Referring now to FIG. 1, an embodiment of a stroke control assembly (SCA) 100 is shown as part of an engine 105. The SCA 100 includes a control plate 110 coupled to a flywheel 160 of significant mass. A guide track 101 is provided as part of the control plate 110 for directing the efficient motion of a rectilinear moving piston 140 as described further below. As such, the amount of power obtainable from the piston 140 may be enhanced. Additionally, as also detailed below, the control plate 110 and flywheel 160 are coupled together in such a manner as to allow a phase shift or overrun of the control plate 110, further enhancing the amount of power obtainable from piston 140 when, for example, force on the control plate 110 may be substantially eliminated. Thus, the SCA 100 may optimally enhance the amount of obtainable power from the piston 140, efficiently determining when, and in what amount, power is ultimately transferred to a power output shaft 150.

Continuing with reference to FIG. 1, the engine 105 employing the SCA 100 is described in further detail. The engine 105 includes a conventional piston 140 that may be fired within a cylinder 143 by conventional means to provide power input to the engine 105. As alluded to above, this power input is the source of the power output that is ultimately delivered by the power output shaft 150 beyond the engine 105. Therefore, enhancing the capture and transfer of this power via the SCA 100 as described herein is of significant benefit.

The piston 140 described above may be a part of a piston device that further includes a rod 145 coupled to a rack 125. The fired piston 140, rod 145, and rack 125 may move downward in what is referred to herein as a power stroke. In the embodiment shown, a swivel mechanism 130 is provided to serve as a coupling interface for the rack 125 and the guide track 101. The swivel mechanism 130 includes rollers 133 rotably secured to a swivel plate 137 and for receiving the guide track 101 therebetween as the control plate 110 rotates. The swivel plate 137 is itself rotably secured to a side of the rack 125 with a rod portion 135 through the center of the rack 125, supported with recessed bearings. Thus, the rollers 133 may guide or track the rack 125 along the path of the guide track 101, the rack 125 moving up or down during the counterclockwise rotation of the control plate 110 as shown. In another embodiment, the swivel mechanism 130 may be swivel rollers 133 rotably secured to a side of the rack 125 on its centerline and distanced from each other for rolling along the exterior surface of the guide track 101. In yet another embodiment, the swivel mechanism 130 may be swivel rollers 133 rotably secured to the rack 125 on its centerline and distanced from each other for rolling along the interior surface of the guide track 101. As indicated, this guided or tracked movement of the rack 125 can be seen in greater detail with reference to FIGS. 4A-4C.

The guide track 101 is configured to enhance the capture of power from the fired piston 140 coupled to the rack 125 during a power stroke. This may be achieved by taking advantage of the circumferential nature of the guide track 101, configuring it such that, at times, it may track a substantially constant velocity rack 125, as the engine 105 cycles. This is described in greater detail below with respect to FIG. 2A.

The power obtainable from the fired piston 140 is also enhanced by the rectilinear motion of the rack 125 itself. Thus, teeth 127 of the rack 125 may tangentially interface a forward pinion gear 175 for the efficient capture of power from the rack 125 as it is forced downward during a power stroke of the fired piston 140. This is a result of the maximum torque naturally present with a tangent interface of a rack and pinion assembly. This is referred to herein as maximum mechanical advantage.

Figure 4A:
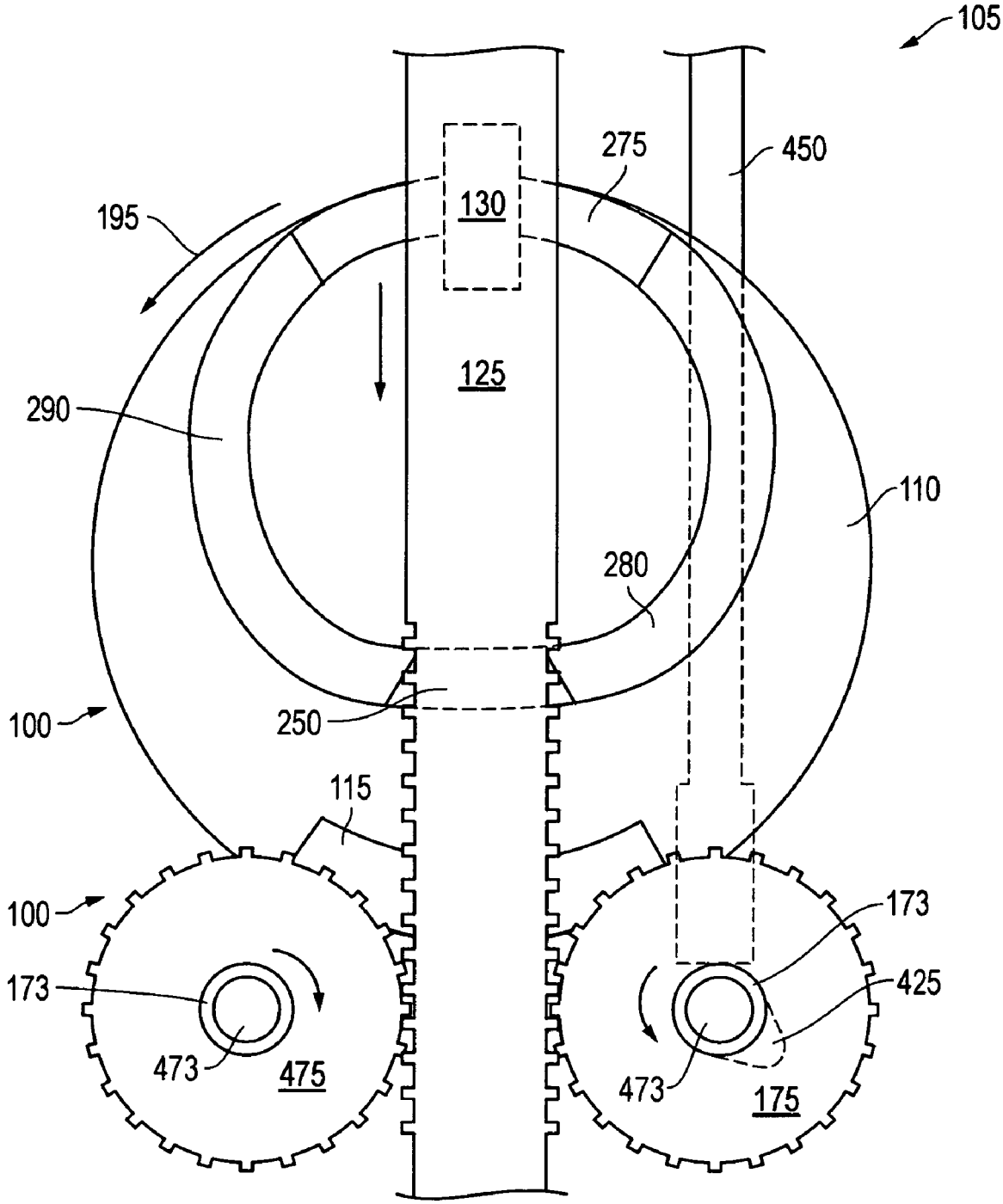
FIG. 4A is a front view of the engine with the SCA of FIG. 1 guiding a stroke at a top dead center position.

As depicted in FIG. 1, the forward pinion gear 175 is rotated in a counterclockwise manner by way of the power stroke. Additionally, in the embodiment of FIG. 1, the forward pinion gear 175 is coupled to a rearward pinion gear 176 by conventional means such as by a mechanical rectifier 173 (one way clutch) and a power transfer shaft (PTS) 473 as seen in FIG. 4A. In this manner, the SCA 100 is compactly positioned between the pinion gears 175, 176. In a preferable embodiment, the output shaft 150 is supported between the pinion gears 175, 176. In one embodiment, the mechanical rectifier 173 may be a friction type clutch, while in another embodiment, the mechanical rectifier 173 may be a fine tooth ratchet type clutch. As a result, the rack 125 may simultaneously and directly interface both the control plate 110, allowing or guiding rectilinear movement of rack 125, and a pinion gear (i.e. 175) for the tangential capture of power as described further herein.

In the embodiment shown in FIG. 1, the rearward pinion gear 176 is substantially identical to the forward pinion gear 175 in configuration. Thus, when flywheel 160 is turning at substantially constant angular velocity, as the downward power stroke angularly accelerates the forward pinion gear 175 counterclockwise up to constant angular velocity, the mechanical rectifier 173 engages and the power transfer shaft 473 and rearward pinion gear 176 rotate counterclockwise to the same degree and at the same given speed. The counterclockwise rotation of the rearward pinion gear 176 in turn transfers power to a power gear 152 of the power output shaft 150, through an intermediate gear 180. As shown in FIG. 1, the power output shaft 150 is driven to a counterclockwise rotation in this manner, which, as indicated above, corresponds to the counterclockwise rotation of the SCA 100.

Figure 2A:
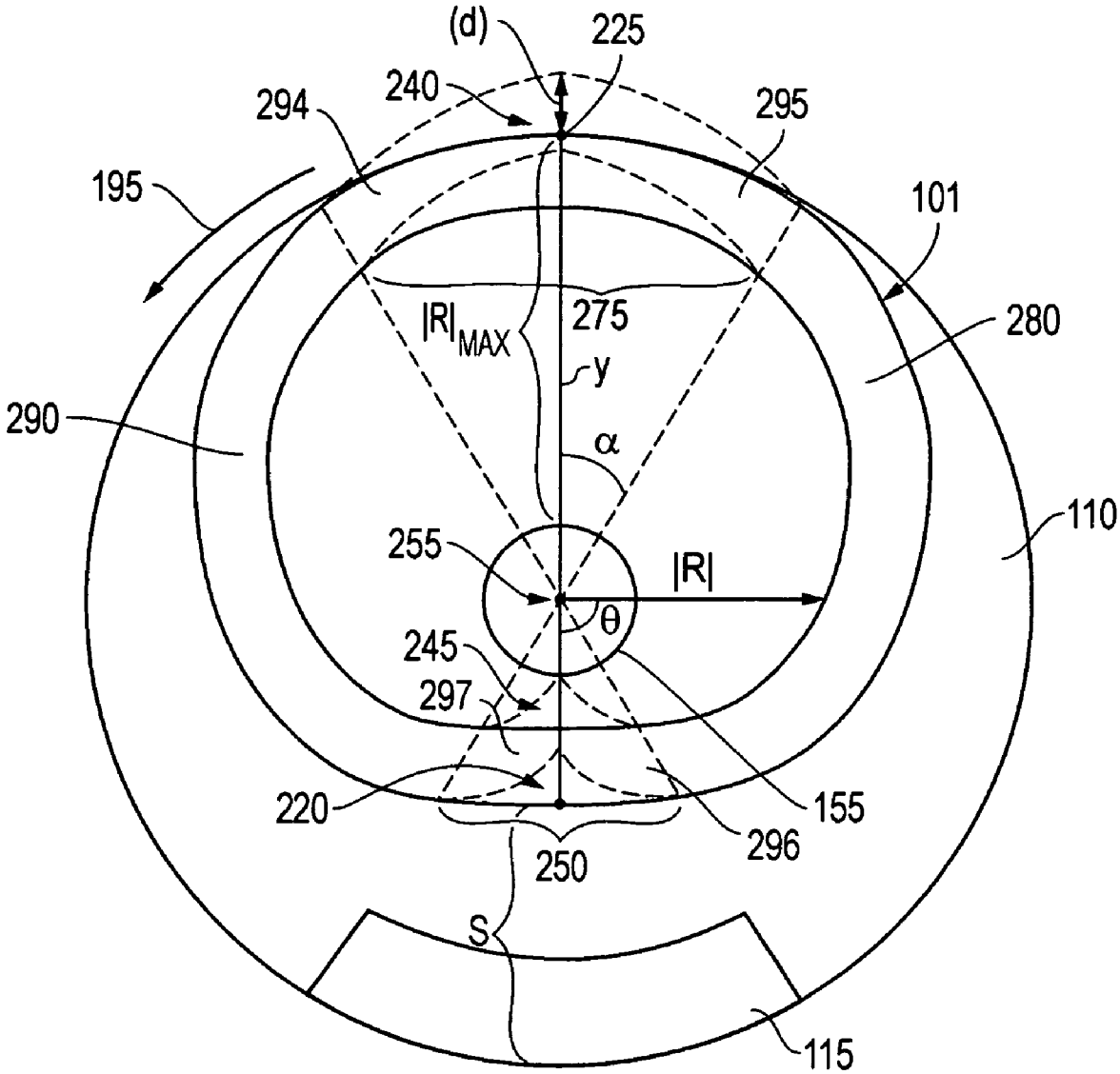
FIG. 2A is a front view of an embodiment of a control plate of the SCA of FIG. 1.
Figure 2B:
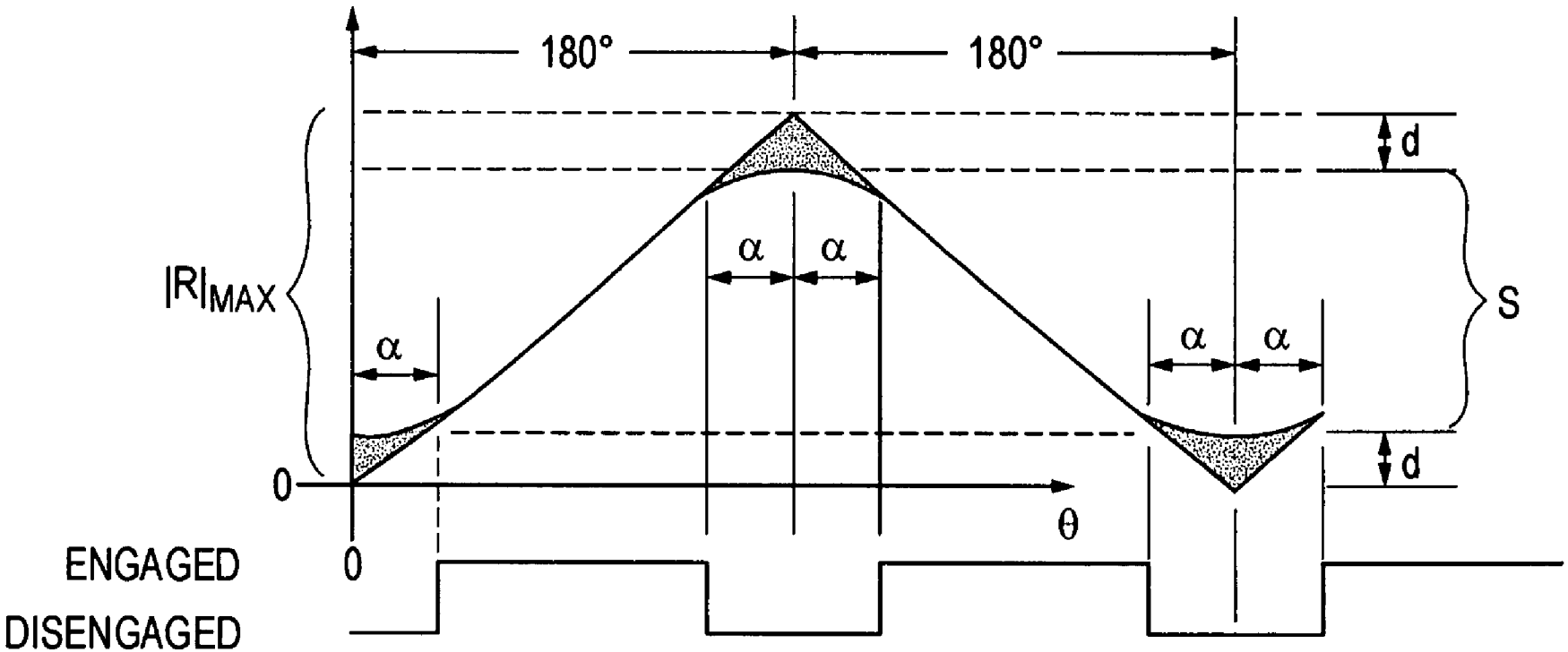
FIG. 2B is a graph of the magnitude |R| of a position vector R for a guide track vs. an angle of rotation.

In one embodiment, with reference to FIGS. 2A, 2B, where (S) is the actual stroke length of piston 140 and (d) is the deviation distance from a mathematically defined linear rack 125 path, the radius of the power gear 152 is about a stroke length plus twice the deviation distance divided by π. That is, $r=(S+2d)/\pi$ for one embodiment of the power gear 152, similar to one embodiment of guide track 101 positioning as described below. Additionally, the radius of the power gear 152 may be about ½ that of the rearward pinion gear 176. As described further herein, correlating the sizing of components, such as these gears 152, 176 and the stroke length, may be employed to provide timing and other capacity to the engine 105 such as for a rotating camshaft (see FIG. 4A).

Continuing with reference to FIGS. 1 and 2A, the forward pinion gear 175 may be held in place by a conventional mechanical rectifier 173. In this manner, the forward pinion gear 175 may capture power from the rack 125 during part of the downward power stroke but move freely in a disengaged fashion from the rearward pinion gear 176 during an upstroke of the rack 125 as described further herein. Thus, in the embodiment shown, the rearward pinion gear 176, power transfer shaft 473, and ultimately the power output shaft 150, continue to rotate only in a counterclockwise direction at substantially constant angular velocity, due to the flywheel 160. This continues to be the case even when the forward pinion gear 175 follows the rack 125 in a clockwise fashion during its upstroke.

As shown in FIG. 1, a single set of forward and rearward pinion gears 175, 176 are apparent for capturing and transferring power to the power output shaft 150. However, in one embodiment pinion gears may be positioned to interface the opposite side of the rack 125 such that with an upstroke of the rack 125 power may be captured by an opposite pinion gear as detailed further below (see 475 of FIG. 4). In one embodiment the rack 125 may even be coupled to a second piston positioned opposite the piston 140 of FIG. 1, thereby providing a powered upstroke. In such an embodiment, significant power may be captured from the rack 125 on both its downstroke as shown in FIG. 1 and during its upstroke, thus, effectively making both strokes of the rack 125, power strokes.

As shown in FIG. 1, the SCA 100 is configured to rotate in the counterclockwise direction as depicted by arrow 195. In particular, the counterclockwise rotation of the control plate 110 about the control plate orifice 155 results in the downward guided movement of the rack 125 by the guide track 101 as shown and described above. At certain times, the control plate 110 and guide track 101 track or follow the rack 125. To counter the weight and position of the guide track 101, a counterweight 115 is provided on the control plate 110 opposite the guide track 101. In this manner, a substantially smooth and balanced rotation of the control plate 110 is furthered.

The SCA 100 also includes a flywheel 160 as indicated above. The flywheel 160 is of significant mass for storing kinetic energy as it too is driven to rotate in a counterclockwise direction about a flywheel orifice 154, in the embodiment shown. Unlike the control plate 110, the flywheel 160 is in continuous powered engagement with the power output shaft 150. That is, as the flywheel 160 rotates, so too does the power output shaft 150. In fact, in the embodiment shown, the power output shaft 150 is directly coupled to the flywheel 160 through the flywheel orifice 154 and configured to stably rotate at the exact same angular velocity as the flywheel 160 itself. Thus, a direct rotational relationship is maintained from the angular velocity of the forward pinion 175 on through to the flywheel 160, during the time when the rack 125 is allowed to move at substantially constant rectilinear velocity and the mechanical rectifier 173 is engaged. As a result, the entire engine 105 may be started by turning the power output shaft 150 and flywheel 160, which may in turn rotate the control plate 110 ultimately effecting movement of the piston 140. Thus, in the embodiment shown, the flywheel 160 is able to impart positive feedback on the engine 105 once it is running.

As described above, the flywheel 160 is configured for conventional tasks such as storing energy, enabling starting of the engine 105, and imparting positive feedback thereon. However, the flywheel 160 is coupled to the control plate 110 in such a manner as to provide unique capacity to the SCA 100. For example, while the flywheel 160 has a direct powered engagement with the power output shaft 150, the control plate 110 does not. Rather, the control plate 110 is coupled to the power output shaft 150 through the flywheel 160 in such a manner as to effectively prevent the control plate 110 from turning the power output shaft 150 in the direction of engine rotation. Rather, the power output shaft 150 and flywheel 160 remain substantially unaffected by the rotation of the control plate 110. This allows for the advantage of overrun or phase shifting of the control plate 110. As a result, force on the control plate 110 may be substantially eliminated, further enhancing the amount of power obtainable from the piston 140.

Continuing with reference to FIGS. 1 and 2A, the particular configuration of the control plate 110 and the guide track 101 are described in further detail. It is worth noting, that while the guide track 101 is referenced below and above as directing, guiding, or tracking the rack 125, for example, through the swivel mechanism 130, the embodiments described herein take advantage of the inherent ability of a rotating device to direct objects toward and away from its center, when provided with a proper track or guiding mechanism such as the described guide track 101. In the embodiments shown, the guide track 101 directs or allows the rack 125 to move in a rectilinear fashion as the SCA 100 rotates. This is achieved by directing or following the rack 125 through up and down strokes. With reference to FIGS. 2A, 2B, the actual distance a fixed point on the rack 125 travels from bottom to top is the length (S) of the actual piston stroke. This distance, in one embodiment, is approximately ⅓ the diameter of the control plate 110.

While the above described motion of the rack 125 is rectilinear, that of the control plate 101 is not. Thus, the guide track 101 follows a circumferential route around the center of the control plate 110 and to a given edge thereof. Given that a circumferential path is to be taken by the guide track 101, it may be configured to display a region where substantially constant velocity of the rack 125 will effect a substantially constant angular velocity of the guide track 101. Thus, embodiments described herein provide a well defined route of the guide track 101, allowing the SCA 100 to enhance the power obtainable from a rectilinear moving piston 140 coupled to the rack 125.

Continuing with reference to FIG. 2A in particular, a front view of the control plate 110 is shown with the counterweight 115 shown opposite the guide track 101. As described above with reference to FIG. 1, the control plate 110 is configured to rotate counterclockwise as shown with the rotation of the guide track 101 guiding or tracking the rack 125 along its rectilinear down and upstrokes. As also indicated above, the guide track 101 appears circumferentially off-center about the control plate orifice 155. As described below, this is a result of establishing the location for each point along the guide track 101 with reference to an angle (θ) (measured in radians) along one side of an imaginary y-axis (y) and mirroring such points of reference for the other side of the y-axis (y). Thus, a downward stroke of the rack 125 is represented by 180° of the control plate 110, whereas the upward stroke of the rack 125 is represented by the remaining 180° of the control plate 110.

Continuing with reference to FIGS. 2A, 2B. 180° of guide track 101 may theoretically be positioned to display a region where guide track 101 and control plate 110 may be evaluated as rotating at constant angular velocity when rack 125 is moving at constant velocity, by reference to the "linear" equation $|R|=(k)(\theta)+C$. In the embodiments shown, C is about the radius of the control plate orifice 155. That is, the origin of the vector R is chosen to be an imaginary point at the center of rotation of control plate 110. In this equation, the magnitude |R| is the distance from the point of origin to a "fixed" point on the center line of the rack 125. It is the "image" of this fixed point projected onto the control plate 110, as the control plate 110 rotates at constant angular velocity while the rack 125 moves up and down at constant velocity, that "defines" the theoretical or unmodified shape of a guide track 101. That is, for each angle of rotation, a unique point is mapped onto the control plate 110. As such, |R| may be determined based on the angle (θ) as noted above, if the constant k and C are known.

The above noted constant k itself is determined by the maximum length of a mathematically linear stroke $|R|_{max}$ divided by π. [i.e. $k=(|R|_{max})/\pi$] (It is useful to note that k also turns out to be about the radius r of the previously mentioned power gear 152, in the embodiment described earlier). So, $|R|=[|R|_{max}/\pi][\theta]+C$. However, it will be shown that it is the modification of the mathematically linear shape of guide track 101 that will enable rack 125 to be accelerated and decelerated, allowing for an engagement and disengagement (respectively) of the mechanical rectifier 173. Therefore, with reference to FIGS. 2A, 2B, it is useful to express $|R|_{max}$ in terms of the actual stroke length (S) (after modification) and the deviation distance (d). It is useful to think of (d) as the distance away from engagement of the mechanical rectifier 173. In words, the maximum mathematically linear stroke $|R|_{max}$ that would allow engagement of the mechanical rectifier for 180° is equal to the actual stroke length (S) that allows engagement for less than 180° plus twice the deviation distance (d) away from engagement.

With reference to FIGS. 2A and 2B, the deviation angle (α) represents the angle where deviation from $|R|=(k)(\theta)+C$ occurs. The deviation distance (d) represents how much deviation from $|R|=(k)(\theta)+C$ there is. So, the general formula for the magnitude |R| in terms of the actual stroke length (S) is $|R|=[(S+2d)/\pi][\theta]+C(0\leqq\theta\leqq\pi)$ and θ is measured in radians. For example, assume the actual length of a stroke (S) is assigned a value of 2.379-inches. From FIG. 2B, (S)/(d) is about 4.5 when the deviation angle (α) is approximately 30°, (π/6 radians). So, (d) is about (S)/(4.5) =(2.379)/(4.5)=0.529-inches. Therefore, $|R|=[(2.379+2(0.529)/(3.14)][\theta]+C$. From this equation it can be seen that |R| depends only on the angle (θ). Note that when θ=0 the length of the position vector |R|=C. This can be seen with reference to FIG. 2A, where C is approximately the radius of orifice 155.

Continuing with the example above, when θ=π/2 radians=3.14/2=1.57, (i.e., 90°) the length of the position vector $|R|=[(2.379+2(0.529))/(3.14)][3.14/2]=1.72$-inches. Finally, when the control plate 110 has turned π-radians, (i.e., 180°) the length of the position vector $|R|=[(2.379+2(0.529))/(3.14)][3.14]=3.44$-inches. Thus, when several points are plotted from θ=0 to θ=3.14, the shape of half a heart results. With reference to FIGS. 2A, 2B; when this shape is mirrored across a line of symmetry (y), a full heart shape (dotted lines) results. So, the actual stroke length (S) [2.379-inches in this example] resulting from the modified shape of guide track 101 (solid lines) is less than the maximum mathematically linear stroke length $|R|_{max}$ (3.44-inches in this example) A key feature of this heart shape and the modified heart shape is that the length of any imaginary line, passing through the center of the control plate 110, originating from and terminating on an edge of the shape, is constant.

Continuing with reference to the embodiment of FIG. 2A, with added reference to FIG. 1, FIG. 2B, most of the guide track 101 is actually positioned according to the equation $|R|=(k)(\theta)+C$. Thus, the amount of power captured from a rectilinear moving piston 140 is enhanced throughout the majority of a cycle of the SCA 100. That is, this is where the mechanical rectifier 173 may be engaged. However, in the embodiments shown, the guide track 101 does deviate from positioning according to $|R|=(k)(\theta)+C$ in a top dead center region 275 and at a bottom dead center region 250. These regions 275, 250 correlate roughly to the shaded regions shown in FIG. 2B. The deviation from $(k)(\theta)+C$ in these regions 275, 250 is present in order to disengage the mechanical rectifier 173, as well as to smooth out the path of guide track 101 so as to avoid a top dead center tortuous region 240 and a bottom dead center tortuous region 245.

Avoidance of these tortuous regions 240, 245 allows the moving piston 140 to avoid abrupt changes in piston direction that would otherwise be necessitated, at about top dead center 225 and at about bottom dead center 220, were adherence to $|R|=(k)(\theta)+C$ positioning maintained by the guide track 101. In a practical sense, this allows the engine 105 to run at relatively high rpm without leading to knocking of the piston 140 and the rack 125 due to lack of deceleration and acceleration, for example, when moving from a down stroke at the right of the y-axis (y) to an upstroke at the left of the y-axis (y) (i.e. see the bottom dead center region 250). Therefore, top dead center region 275 contains a deceleration portion 294 and an acceleration portion 295; and bottom dead center region 250 contains a deceleration portion 296 and an acceleration portion 297.

The determination of how to precisely configure and smooth out the top and bottom dead center regions 275, 250 may be based on a variety of factors. For example, in one embodiment, the top dead center region 275 may be thought of as including a predetermined location for phase shifting, referred to herein as an acceleration portion 295. That is, as a piston 140 is fired and begins its downward power stroke the control plate 110 may angularly accelerate and even phase shift relative to the flywheel 160, as detailed further below with reference to FIG. 3. The amount of phase shift may be a factor in determining how large to make the acceleration portion 295. Additionally, in one embodiment, once the acceleration portion 295 is configured, the remaining portions of the top and bottom dead center regions 275, 250 may be tailored accordingly. For example, the acceleration portion 295 may correlate to a given angle, as measured from the y-axis (y). Thus, the remaining portions of the top and bottom dead center regions 275, 250 may be established according to an equivalent angle. In one embodiment the angle (α) is between about 25° and 35°, preferably about 30°, and each of the top and bottom dead center regions 275, 250 are between about 50° and 70° in total, centered about the top dead center 225 and bottom dead center 220, respectively. With reference to FIG. 2B, the portion where engagement of the mechanical rectifier 173 may not occur, may also be a factor in determining how to precisely configure and smooth out the top and bottom dead center regions 275, 250. That is, there may be a trade off. In general, high rpm and low vibration may be weighed against maximizing the amount of time the mechanical rectifier 173 is engaged.

In the embodiment described above, the top and bottom dead center regions 275, 250 represent the only locations at which the rack 125 may fail to move at a constant velocity. However, in these same embodiments, the top and bottom dead center regions 275, 250 take up no more than about 140°. Thus, the remainder of the guide track 101, at least about 220° worth, is made up of engagement regions 280, 290. With reference to FIG. 2B, it is in these engagement regions 280, 290 that engagement of the mechanical rectifier 173 may occur. The engagement regions 280, 290 follow $|R|=(k)(\theta)+C$ positioning. Therefore, as the control plate 110 turns across these engagement regions 280, 290, the mechanical rectifier 173 may be engaged, allowing rack 125 to work against the massive flywheel 160, which, by its nature, is also turning at substantially constant angular velocity. As a result, maximum mechanical advantage may be employed on the forward pinion gear 175 to enhance the capture of power from a rectilinear moving piston 140 throughout most of the rotation of the control plate 110.

As described above, the configuration of the guide track 101 may enhance the capture of power from a rectilinear moving piston 140. However, as also alluded to above, the guide track 101, and indeed the entire SCA 100, may be configured to also employ a phase shift, further enhancing the amount of power obtainable from piston 140 when, for example, force on the control plate 110 may be substantially eliminated, thus optimally enhancing the amount of obtainable power from piston 140, as well as efficiently determining when, and in what amount, that power is ultimately transferred to the output shaft 150, as described below.

Figure 3:
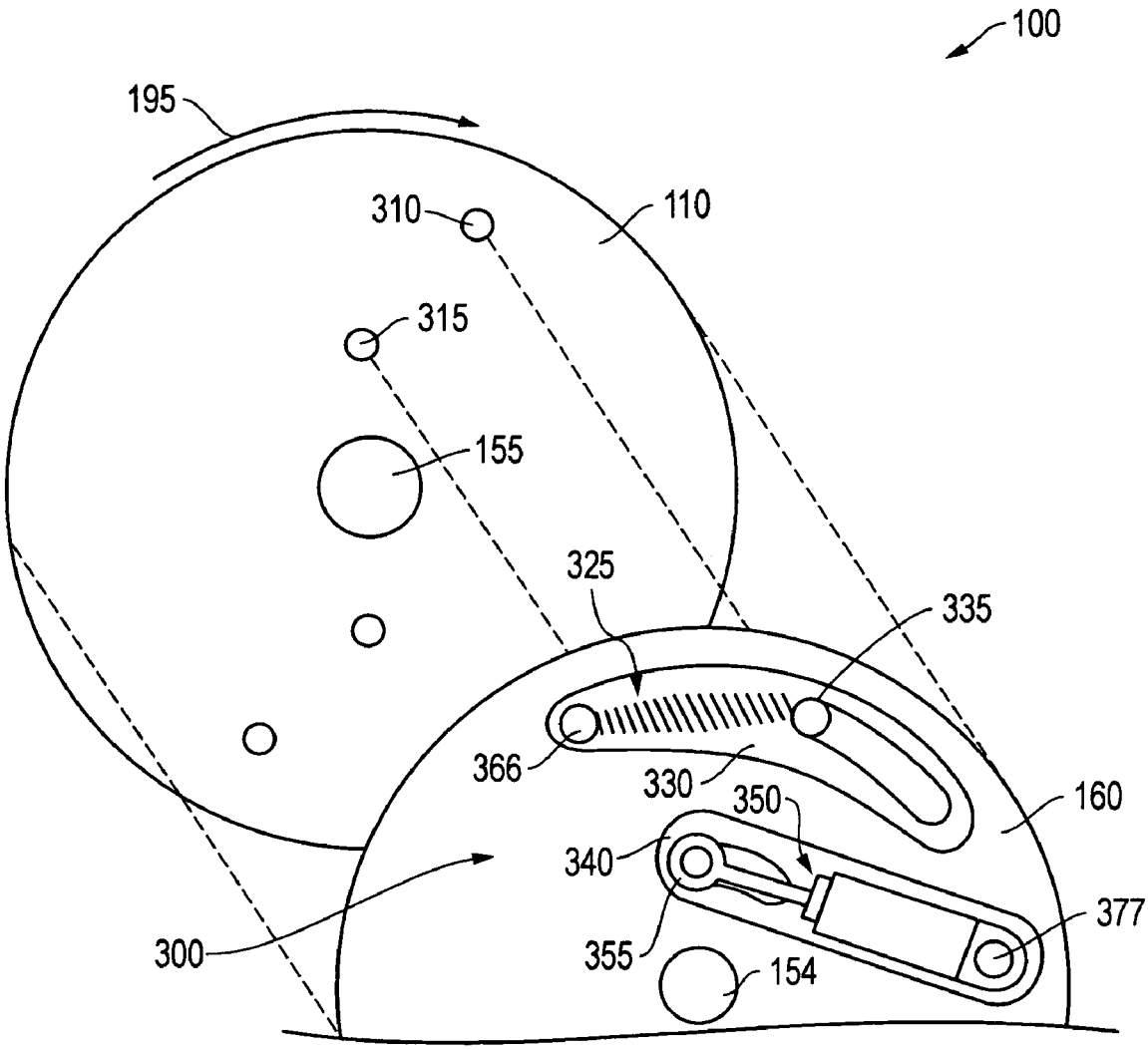
FIG. 3 is a rear exploded view of the SCA of FIG. 1.

Referring now to FIG. 3 with additional reference to FIGS. 1, 2A, and 2B, a rear exploded view of the SCA 100 is shown revealing the ability of the control plate 110 to rotate independent of the flywheel 160 to a degree. The SCA 100 may be configured to allow for such overrun of the control plate 110 in small increments where torque on the control plate 110, due to the stroking piston 140, is near a minimum, for example, when the swivel mechanism 130 is positioned in the acceleration portion 295 of the guide track 101. In this manner, because acceleration portion 295 is a portion of disengagement of the mechanical rectifier 173, power from the rectilinear moving piston 140 may be directed substantially at the light weight control plate 110, when torque on the control plate 110 is near a minimum, rather than at both the control plate 110 and the flywheel 160 of significantly more mass. So, for example, depending on the amount of force from piston 140, there will be some degree of overrun by the control plate 110, efficiently determining when power will ultimately be transferred to the output shaft 150. That is, the sooner engagement region 280 is encountered, the sooner further enhancement of the power obtainable from piston 140 will occur, as force on the control plate 110 may be substantially eliminated, in this engagement region 280.

Continuing with reference to FIGS. 1-3, the SCA 100 is coupled to the rack 125. As indicated above, rectilinear movement of the rack 125 may effect rotation of several portions of the engine 105 including the SCA 100. As shown in FIGS. 1 and 2A, the SCA 100 is configured to rotate counterclockwise when viewed from the front as indicated by arrow 195. With reference to FIG. 3, a rear exploded view of the SCA 100 is shown. Therefore, the SCA 100 appears configured for clockwise rotation. However, as indicated by arrow 195 this rotation is actually the same in all of FIGS. 1-3.

Continuing with reference to the rear view of the SCA 100 as shown in FIG. 3, the control plate 110 is aligned with the flywheel 160 with a semi-rotable coupling therebetween as alluded to above. That is, the control plate 110 is coupled to the flywheel 160 such that the control plate 110 may rotate at least to some degree irrespective of the rotation of the flywheel 160. This provides the SCA 100 with the benefit of overrun or phase shifting as indicated above and detailed further herebelow. Alternatively, while the control plate 110 may rotate to a degree without effecting rotation of the flywheel 160, the reverse may not be the case. That is, in the embodiment shown, rotation of the flywheel 160, at any rate meeting or otherwise exceeding the rotation of the control plate 110, will drive rotation of the control plate 110. That is, in the embodiment shown, the flywheel 160 is configured to drive, rather than overrun, the control plate 110 where applicable.

As indicated above, the flywheel 160 is of significant mass as compared to the mass of the control plate 110. In fact, in many embodiments the flywheel 160 may be from about 5 to about 20 times the mass of the control plate 110. In one embodiment the control plate 110 is of a light weight aluminum alloy whereas the flywheel 160 is of cast iron or steel. The control plate 110 may even be configured with perforations or other features to further reduce its mass. Additionally, the flywheel 160 may be anywhere from about 2 to about 10 times the thickness of the control plate 110 depending on factors such as internal size limitations.

The SCA 100 takes advantage of the disparity in mass between the flywheel 160 and the control plate 110 as indicated above. That is, as noted, a rotating comparatively larger mass flywheel 160 is coupled to the control plate 110 such that it may drive the rotation of the control plate 110 whenever the control plate 110 fails to exceed the rotational speed of the flywheel 160. On the other hand, the comparatively light weight control plate 110 may rotate freely to a degree without necessarily driving the rotation of the comparatively much heavier flywheel 160. Thus, in engagement region 280, force applied to control plate 110, while transferring power from the rectilinear moving piston 140 to the power output shaft 150, may be minimized. That is, this rotational interplay allows for further enhancement of the transfer of power to the power output shaft 150 of the engine 105, as described further below.

Continuing with reference to FIGS. 2A and 3, with added reference to FIG. 1, the guide track 101 is configured with engagement regions 280, 290 as indicated above. Thus, with reference to a downward power stroke, the swivel mechanism 130 of the rack 125 leaves the acceleration portion 295 and, with a constant speed of the piston 140, enters the initial engagement region 280 to drive the control plate 110 with a substantially insignificant force, at a constant angular velocity, as the mechanical rectifier 173 firmly engages. At this point, the control plate 110 and flywheel 160 may be rotating at a substantially equivalent rate as the piston 140 no longer correlates with the slowing down or speeding up reflected at the top dead center region 275. At this same time, with torque available through the location of the swivel mechanism 130, power from the rectilinear moving piston 140 is efficiently transferred through the pinion gears 175, 176 and ultimately to the power output shaft 150 with no significant force on the control plate 110.

Continuing with reference to a full downward power stroke, however, the swivel mechanism 130 actually begins its travel along the guide track 101 at the top dead center region 275 where the piston 140 fails to travel at a constant speed. In fact, upon entry into the top dead center region 275, by the swivel mechanism 130, the piston 140 was in the process of slowing down until reaching top dead center 225. That is, swivel mechanism 130 has already passed through deceleration portion 294. In doing so, the mechanical rectifier 173 was forced to disengage due to the slowing of the rack 125 and piston 140. During that time, it was the rotation of the flywheel 160 that drove the control plate 110 to continue its rotation as described above. That is, the phase shift was forced back to 0° by the rack 125, as piston 140 was working against compression. This is an example of the efficient use of the significant mass of the flywheel 160 to drive the control plate 110 as described above. Driving of the control plate 110 in this manner brings the swivel mechanism 130 into the acceleration portion 295, at the outset of the power stroke.

At the outset of the power stroke, the fired piston 140 accelerates. In fact, it is at this time that the rack 125 may begin to force a rotation of the control plate 110, through the guide track 101, that is faster than the SCA 100, as driven by the flywheel 160, is already rotating. However, it is also at this time, when the swivel mechanism 130 is near top dead center 225, that torque on the SCA 100 is negligible. That is, torque on control plate 110 is negligible as substantial force from the stroking piston 140 occurs along a line of symmetry (y). However, torque on the flywheel 160 is negligible, as top dead center region 275 is also a region where disengagement of the mechanical rectifier 173 occurred, as indicated above. Therefore, a transfer of power is impending. Efficiently determining when, and in what amount, power is transferred to the output shaft 150, while substantially eliminating force on control plate 110, may be accomplished by the phase shifting of control plate 110 relative to the flywheel 160. It is the ability of the control plate 110 to phase shift at this time that optimally enhances the amount of power ultimately transferred to the power output shaft 150.

As indicated above, the acceleration of the control plate 110 as the swivel mechanism 130 enters the acceleration portion 295 of the top dead center region 275 may lead to a phase shift or overrun of the control plate 110 relative to the flywheel 160. That is, as indicated above, the control plate 110 may slip ahead to a degree, briefly rotating faster than the flywheel 160. Thus, given the light weight and mass of the control plate 110, the downward power stroke of the piston 140 proceeds with the swivel mechanism 130 traversing the acceleration portion 295. The degree of slip, and thus, when power is ultimately transferred to the output shaft 150, may be determined automatically and dynamically in this portion 295. That is, as swivel mechanism 130 traveled through deceleration portion 294, the rack 125 was slowed, until the swivel mechanism 130 reached top dead center 225. With reference to FIG. 2B, there is an effective rectilinear distance (d) that the rack 125 was pulled out of engagement. Indeed, this same distance (d) must be traversed, if the rack 125 is to reengage the mechanical rectifier 173. Since the control plate 110 is free to rotate, or slip ahead, in this portion 295, the time it takes to traverse this distance (d) may be shortened. That is, a larger force, from the fired piston 140, forces more slip. Therefore, distance (d) is traversed faster. Thus, the time when power is ultimately transferred to power output shaft 150 may be efficiently determined, in portion 295. However, as will be seen, additional enhancement may be possible, for example, when force on the control plate 110 is substantially eliminated, further enhancing the amount of obtainable power from piston 140.

Subsequently, the swivel mechanism 130 enters the engagement region 280 and the phase shift of the control plate 110 ceases. However, at this point, with the swivel mechanism 130 further from top dead center 225, the amount of torque on the SCA 100 may be substantially increased. That is, rack 125 is now able to engage mechanical rectifier 173 as rack 125 works against forward pinion gear 175. That is, at this point, rack 125 is tangentially applying substantially all force from fired piston 140 to forward pinion gear 175. Thus, rack 125 is forced to move at substantially constant velocity as it works against flywheel 160 and power output shaft 150. Therefore, maximum mechanical advantage may exist in engagement region 280, as control plate 110 slips or shifts a bit more, in order to enable a firm engagement of mechanical rectifier 173. As swivel mechanism 130 moves through this engagement region 280, control plate 110 follows. That is, control plate 110 is effectively tracking or following along via a substantially insignificant effectuation force from rack 125 through guide track 101 due to the disconnection and comparatively small mass of control plate 110 with respect to flywheel 160. As a result, the SCA 100 may optimally enhance the amount of obtainable power from piston 140 by substantially eliminating force on control plate 110.

With particular reference to FIG. 3, a dampening mechanism 300 visible from the rear of the SCA 100 is shown to provide a substantially controlled transition of the control plate 110 into and out of the phase shift. That is, while not operationally required, the dampening mechanism 300 may nevertheless be employed to allow the above-described phase shift to occur smoothly while also bringing the control plate 110 and the flywheel 160 smoothly back into alignment as the speed of the flywheel 160 catches up to that of the control plate 110. That is, the dampening mechanism 300 provides a controlled transition to the control plate 110 into and out of its phase shift.

Further, the presence of a dampening mechanism 300 may prevent the control plate 110 from continually overrunning the flywheel 160 without effect, for example, to help prevent engine failure if there is a problem in maintaining rotation of a disfunctioning flywheel 160. A flywheel 160 may be disfunctioning if control plate 110 is driving flywheel 160 in the direction of engine 105 rotation. This may be of increased importance in certain applications such as for aircraft engines.

As shown in FIG. 3, the dampening mechanism 300 includes a spring 325 within a spring recess 330 of the flywheel 160 and coupled to the flywheel 160 at a spring coupling 366. A hydraulic shock 350 is fitted within a shock recess 340 of the flywheel 160 coupling it thereto at shock coupling 377. The spring 325 is coupled to the control plate 110 by a spring loop 335 which is secured to a spring protrusion 310 which extends from the control plate 110 and into the spring recess 330 at a location opposite the spring coupling 366. Thus, as the control plate 110 overruns the flywheel 160 in the direction of arrow 195, the spring 325 extends to smoothly control the overrun. Similarly, the hydraulic shock 350 is coupled to the control plate 110 by a shock loop 355 which is secured to a shock protrusion 315 extending from the control plate 110 and into the shock recess 340. Thus, as the control plate 110 overruns the flywheel 160, the hydraulic shock 350 contracts providing additional control as the control plate 110 overruns the flywheel 160.

As shown in FIG. 3, and with added reference to FIG. 2A, the dampening mechanism 300 is positioned above the flywheel orifice 154 for control of overrun which may occur as the rack 125 interfaces the acceleration portion 295 after top dead center 225 as noted above. However, in most embodiments an additional dampening mechanism 300 may be positioned below the flywheel orifice 154 for again controlling the overrun as described above. The damping coefficients for shock 350, as well as the spring constant for spring 325, may be determined based on the fact that protrusions 310, 315 may not reach the end of their travel, in a preferred embodiment, when engine 105 is under maximum load.

Figure 4B:
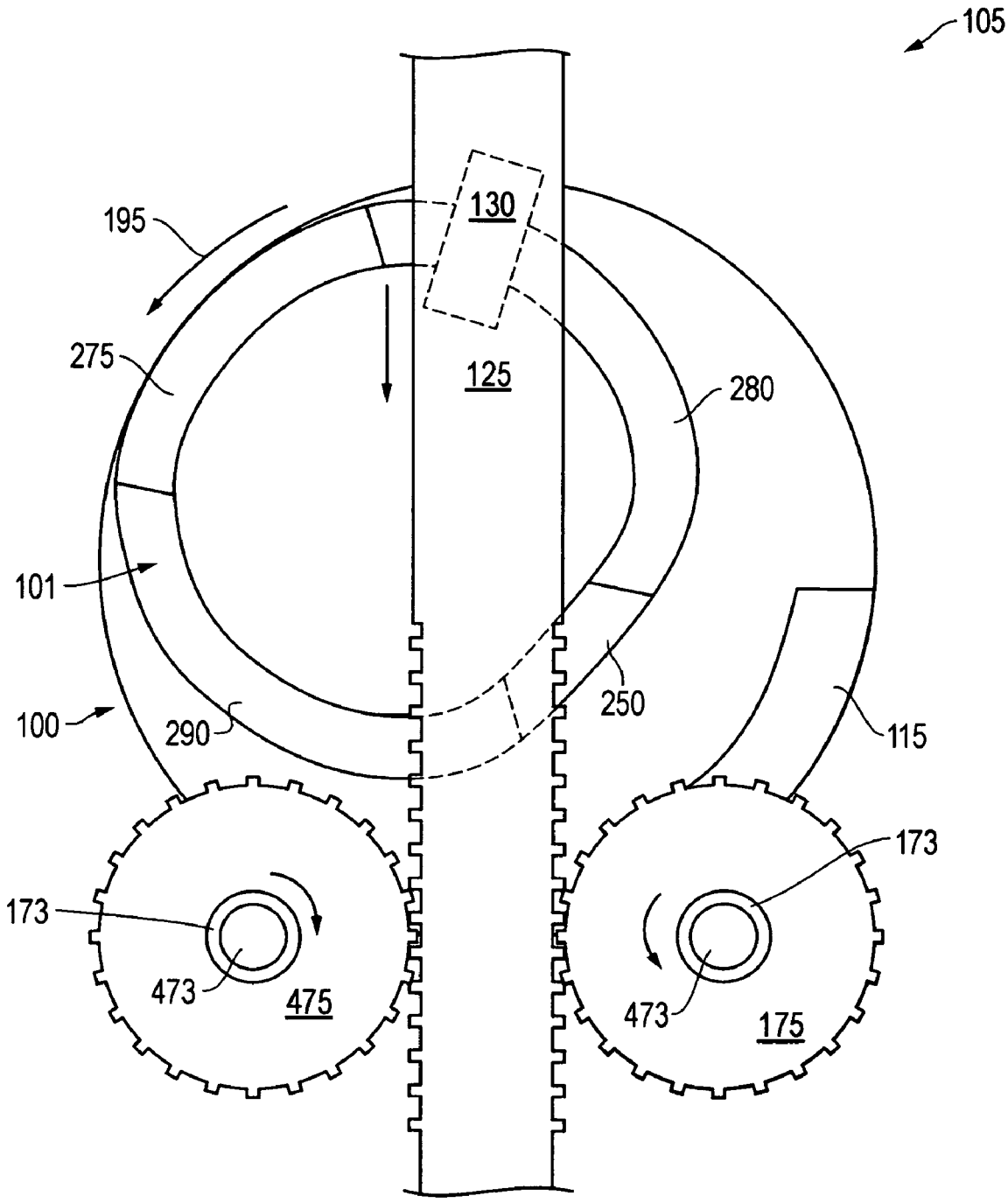
FIG. 4B is a front view of the engine and SCA of FIG. 1 guiding a stroke through a region of substantially constant velocity.
Figure 4C:
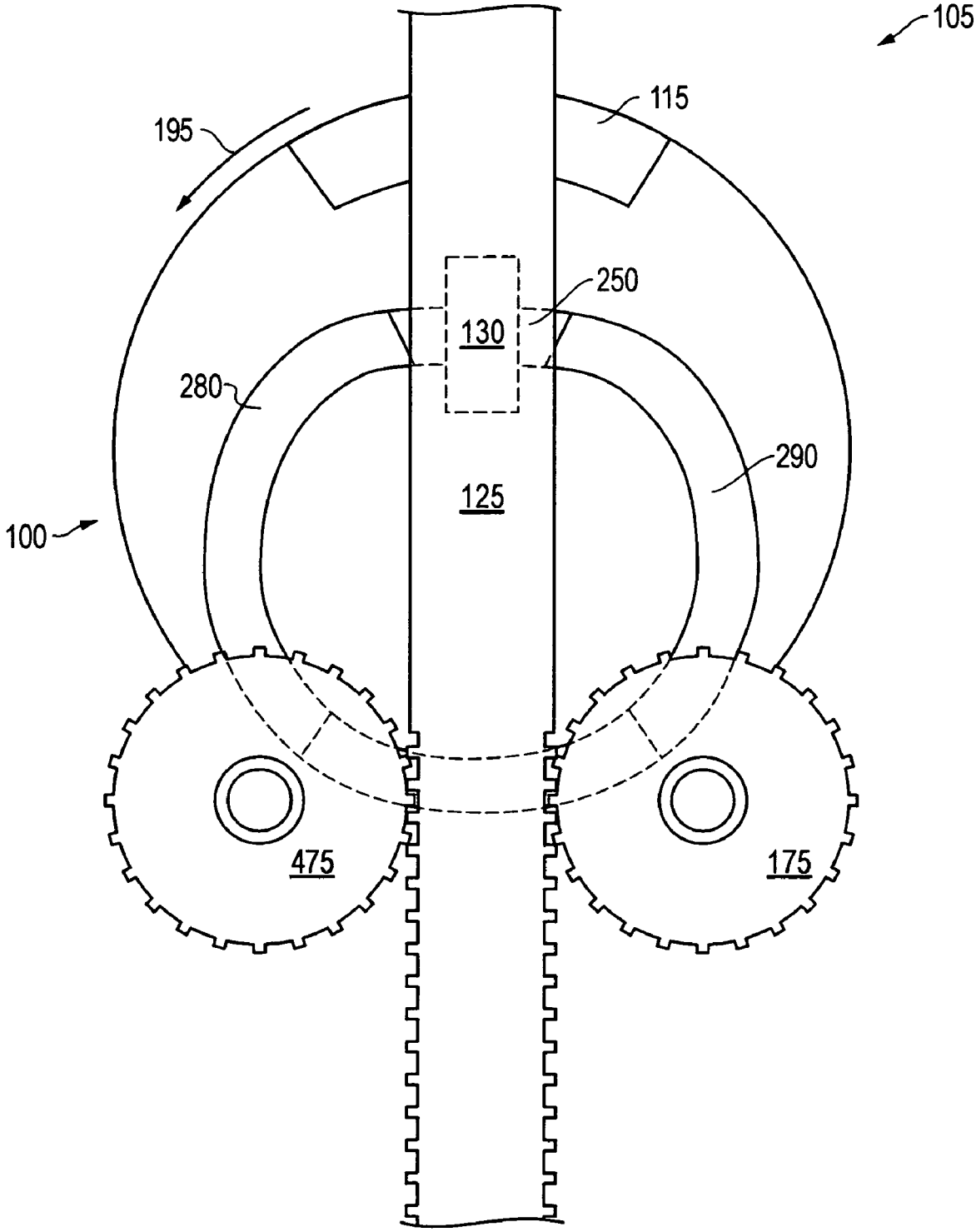
FIG. 4C is a front view of the engine and SCA of FIG. 1 guiding a stroke at a bottom dead center position.

Referring now to FIGS. 4A-4C, a front view of the engine 105 of FIG. 1 is shown with the SCA 100 guiding a power stroke of the rack 125 from a top dead center region 275 through an engagement region 280 and to a bottom dead center region 250. As shown in FIG. 4A, the swivel mechanism is positioned at about the center of the top dead center region 275 (i.e. at about top dead center 225 as shown in FIG. 2A). Acceleration of the rack 125 downward is imminent as the control plate 110 rotates (see arrow 195). As the rack 125 and swivel mechanism 130 accelerates through the remainder of the top dead center region 275, the phase shift as described above will occur with the rotation of the control plate 110 slipping ahead of the rotation of the flywheel 160 (see FIG. 1). Thus, efficiently determining when power is ultimately transferred to output shaft 150.

The embodiment shown in FIG. 4A also reveals other advantageous features that may be employed by an engine 105 utilizing an SCA 100 as described herein. For example, as shown in FIG. 4A, a cam lobe 425 may be coupled between, or to the outside of, pinion gears 175, 176 and rotable in accordance with the rotation of the rearward pinion gear 176. In this manner a valve actuator 450 or other mechanism for coupled timing with the cycling of the engine 105 may be employed. As indicated above, the rearward pinion gear 176 may be configured in relation to size of the power gear 152 for tailoring a rotational relationship between the cam lobe 425, valve actuation, and power output. For example, in one embodiment the rearward pinion gear 176 is of a radius about twice that of the power gear 152.

FIG. 4A also reveals an opposite forward pinion gear 475 for receiving power from the rack 125 during an upstroke thereof. Like the forward pinion gear 175 a one way clutch or mechanical rectifier 173 may be employed to ensure that power is translated beyond the opposite forward pinion gear 475 only during the proper stroke of the rack 125 (e.g. the upstroke in the case of the opposite forward pinion gear 475).

Referring now to FIG. 4B, with added reference to FIG. 1, the swivel mechanism 130 enters the initial engagement region 280. At this point of the power stroke, the phase shift of the control plate 110 is complete and added torque is available for turning of the entire SCA 100. Thus, power is efficiently directed from the rack 125 and to both the flywheel 160 and the power output shaft 150, as the swivel mechanism 130 moves through the engagement region 280.

Referring now to FIG. 4C the swivel mechanism 130 is now shown traversing the bottom dead center region 250. At this time, the downstroke of the rack 125 and the rotation of the forward pinion gears 175, 475 have all momentarily stopped as the piston moves from its downstroke to an impending upstroke. Upon the upstroke, the rack 125 will move upward as the rotations of the forward pinion gears 175, 475 as shown in FIGS. 4A and 4B reverse. At this time, the potential for power collection from the rack 125 will move from potential for collection by the forward pinion gear 175 to potential for collection by the opposite forward pinion gear 475 as directed by conventional mechanical rectifier capacity in each.

With added reference to FIG. 1, in one embodiment, the rack 125 is ultimately coupled to both the piston 140 of FIG. 1 at one end and to a second piston at the opposite end of the rack 125. In this manner, additional power may be directed through the opposite forward pinion gear 475 and ultimately to the power output shaft 150. Further, a phase shift of the control plate 110 may take place as described above as the swivel mechanism 130 passes through the bottom dead center region 250. Thus, the power directed through the opposite forward pinion gear 475 and to the power output shaft 150 may be enhanced and even optimally enhanced.

An engine 105 employing an embodiment of the above-described SCA 100 may be started by rotation of the power output shaft 150 and the flywheel 160 of the SCA 100 via conventional means. The rotation of the flywheel 160 of the SCA 100 may rotably drive the control plate 110 of the SCA 100. Rotation of the control plate 110 may effect stroking of the rack 125 as a swivel mechanism of the rack 125 is pulled along a guide track 101 of the control plate 110.

Once the cycling of the engine 105 takes hold power may begin to be drawn from a piston 140 fired within a cylinder 143 and coupled to the rack 125. The downward power stroke of the rectilinear moving piston 140 may deliver power to the power output shaft 150 through a set of pinion gears 175, 475 that tangentially interface the rack 125. Due to configuration of the SCA 100 as described above, the downward power stroke begins with substantially all force from piston 140 being held by control plate 110. Depending on the amount of force from piston 140, a phase shift may begin. Thus, efficiently determining when power from the rack 125 is ultimately transferred to pinion gears 175, 475. When the downward power stroke encounters the engagement region 280, the phase shift increases just enough to allow firm engagement of the mechanical rectifier 173 and then the shift ceases, optimally enhancing the amount of power transferred to the rack 125 to be directed to the pinion gears 175, 475 without significant force on the control plate 110. Similarly, in an embodiment where the upstroke of the rack 125 is powered, a phase shift may be provided at the outset of the upward power stroke.

The embodiments described herein may be applied to a rectilinear stroking piston and rack in such a manner as to avoid unnecessary drain in power, while maximizing torque throughout the majority of a power stroke. This may be achieved by allowing for a phase shift, as described above, further enhancing and even optimally enhancing the amount of power obtainable from a piston when, for example, force on the control plate may be substantially eliminated. Furthermore, embodiments described herein maintain coupling between a control plate, for guiding the rectilinear return of a piston, and a flywheel. Thus, due to positive feedback, the engine may be started by rotation of a power output shaft and the flywheel.

Although exemplary embodiments described above include a particular engine employing a given stroke control assembly (SCA), additional embodiments and features are possible. For example, the rack may be fairly flat on two sides for ease of oil lubrication. Additionally, a single rack may have two swivel mechanisms for coupling to two SCA's (e.g. one at each side of the rack). In such an embodiment, a continuous power transfer shaft may continuously couple all forward and rearward pinion gears, for multiple in-line cylinders, on one side of the SCA while the power output shafts from the assemblies are provided in a discontinuous fashion, along the centerline of the SCA. In one embodiment, the cylinder of the damping piston (shock piston) may be cast or machined into the flywheel. In an embodiment where the rack is powered in both directions, phase shifting torque about the center of the control plate may be the same in each direction, when the above defined alternate swivel mechanism is employed. In one embodiment, multiple protrusions from the control plate may assist in limiting the slip or shift range of the control plate. Furthermore, many other changes, modifications, and substitutions may be made without departing from the scope of the described embodiments.

I claim:

1. A rotatable assembly to direct power from a moving piston device, the assembly comprising:

a flywheel coupled to an output shaft configured to obtain the power:

a guide track to interface the piston device, said guide track comprising an engagement portion and a predetermined location; and a control plate accommodating said guide track to receive the power from the piston device, said control plate rotatably coupled to said flywheel to transfer the power thereto, said control plate to rotatably phase shift ahead of said flywheel as the piston device moves from encountering the predetermined location to interfacing the engagement portion.

2. The assembly of claim 1 wherein said flywheel is between about 5 and about 20 times the mass of the control plate.

3. The assembly of claim 1 wherein the predetermined location is of between about 25° and about 35° of a rotation of said control plate.

4. The assembly of claim 1 wherein at least about 220° of said control plate accommodates engagement portion.

5. The assembly of claim 4 wherein the guide track includes a dead center region separate from the engagement portion, the dead center region encompassing the predetermined location.

6. The assembly of claim 5 wherein the dead center region is a top dead center region and the predetermined location is a first predetermined location corresponding to the outset of a downward power stroke of the moving piston device, the guide track further including a bottom dead center region separate from the top dead center region and encompassing a second predetermined location wherein said control plate is to rotatably phase shift ahead of said flywheel when encountered by the piston device, the second predetermined location corresponding to the outset of an upward power stroke of the moving piston device.

7. The assembly of claim 1 further comprising a dampening mechanism coupled to said control plate and said flywheel to provide one of a substantially controlled transition of the control plate into the phase shift and a substantially controlled transition of the control plate out of the phase shift.

8. The assembly of claim 7 wherein said dampening mechanism is configured to allow said control plate to rotatably drive said flywheel.

9. An engine comprising:

a piston device for moving in a rectilinear manner to generate power;

a flywheel coupled to an output shaft configured to obtain the power;

a guide track to interface the piston device, said guide track comprising an engagement portion and a predetermined location; and a control plate accommodating said guide track to receive the power from the piston device, said control plate rotatably coupled to said flywheel to transfer the power thereto, said control plate to rotatably phase shift ahead of said flywheel as the piston device moves from encountering the predetermined location to interfacing the engagement portion.

10. The engine of claim 9 wherein the piston device includes a piston coupled to a rack, the rack for interfacing the guide track at a swivel mechanism to follow along the guide track during moving of the piston device.

11. The engine of claim 10 wherein the rack includes a flat surface to enhance lubrication thereof.

12. The engine of claim 9 further comprising a pinion gear and mechanical rectifier for tangentially interfacing said piston device to collect power therefrom during rectilinear movement thereof.

13. The engine of claim 12 further comprising a power gear, said pinion gear for coupling to said power gear to provide power output to the engine.

14. The engine of claim 13 wherein said pinion gear is a forward pinion gear, the engine further comprising:

a power transfer shaft;

a rearward pinion gear coupled to said forward pinion gear by said shaft and mechanical rectifier; and an intermediate gear coupled to said rearward pinion gear and said power gear, said power transfer shaft said rearward pinion gear, and said intermediate gear to provide the coupling of said forward pinion gear to said power gear.

15. The engine of claim 14 further comprising:

at least one cam lobe coupled to one of said power transfer shaft, and said rearward pinion gear; and a valve actuator for rotatable effectuation by said cam lobe.

16. The engine of claim 15 wherein said rearward pinion gear is of a radius about twice that of the power gear.

17. A method of directing power from a moving piston, the method comprising:

moving the piston in a rectilinear manner;

rotating an assembly having a control plate coupled to a flywheel in response to said moving, the control plate having a guide track to interface the piston for transferring the power to the flywheel, the flywheel coupled to an output shaft configured to obtain the power therefrom; and phase shifting rotation of the control plate ahead of rotation of the flywheel during said rotating, said phase shifting to occur as the piston moves from encountering a predetermined location of the guide track to encountering an engagement portion of the guide track.

18. The method of claim 17 further comprising driving rotation of the control plate with the piston device moving wherein said moving takes place at a substantially constant velocity, said driving to occur at a substantially constant angular velocity of the control plate for at least about 220° of a rotation of the control plate.

* * * * *